US011060685B2

(12) United States Patent
Schadenhofer et al.

(10) Patent No.: US 11,060,685 B2
(45) Date of Patent: Jul. 13, 2021

(54) PROJECTION DEVICE FOR A MOTOR VEHICLE HEADLIGHT AND METHOD FOR PRODUCING A PROJECTION DEVICE

(71) Applicant: ZKW Group GmbH, Wieselburg (AT)

(72) Inventors: Peter Schadenhofer, Roggendorf (AT); Alexander Hacker, Wilhelmsburg (AT); Josef Gürtl, Kilb (AT)

(73) Assignee: ZKW GROUP GMBH, Wieselburg (AT)

( * ) Notice: Subject to any disclaimer, the term of this patent is extended or adjusted under 35 U.S.C. 154(b) by 0 days.

(21) Appl. No.: 16/955,387

(22) PCT Filed: Nov. 27, 2018

(86) PCT No.: PCT/EP2018/082687

§ 371 (c)(1),
(2) Date: Jun. 18, 2020

(87) PCT Pub. No.: WO2019/120900

PCT Pub. Date: Jun. 27, 2019

(65) Prior Publication Data

US 2021/0123578 A1 Apr. 29, 2021

(30) Foreign Application Priority Data

Dec. 20, 2017 (EP) ..... 17208913

(51) Int. Cl.
*F21S 41/275* (2018.01)
*F21S 41/43* (2018.01)
(Continued)

(52) U.S. Cl.
CPC ..... *F21S 41/275* (2018.01); *F21S 41/143* (2018.01); *F21S 41/321* (2018.01); *F21S 41/43* (2018.01); *F21W 2102/13* (2018.01)

(58) Field of Classification Search
None
See application file for complete search history.

(56) References Cited

U.S. PATENT DOCUMENTS 6,769,777 B1 * 8/2004 Dubin ..... F21V 11/186 353/97
9,951,919 B2 4/2018 Bauer et al.
(Continued)

FOREIGN PATENT DOCUMENTS

DE 102015121691 A1 6/2017

OTHER PUBLICATIONS

PCT International Search Report and Written Opinion for PCT/EP2018/082687, dated Jan. 4, 2019 (17 pages).

*Primary Examiner* — Britt D Hanley
(74) *Attorney, Agent, or Firm* — Eversheds Sutherland (US) LLP

(57) ABSTRACT

The invention relates to a projection device (1) for a motor vehicle headlight, wherein the projection device (1) is configured to project light from at least one light source (2) associated with the projection device (1) in a region in front of a motor vehicle in the form of at least one light distribution, wherein a light-impermeable coating consists of partial layers arranged in an at least planar manner one on top of the other, specifically a reflective metal first partial layer (6) and a second partial layer (6") consisting substantially of black light-absorbing paint, wherein the first partial layer (6') is arranged between the input lens system (3) and the second partial layer (6").

15 Claims, 5 Drawing Sheets

Figure 1:
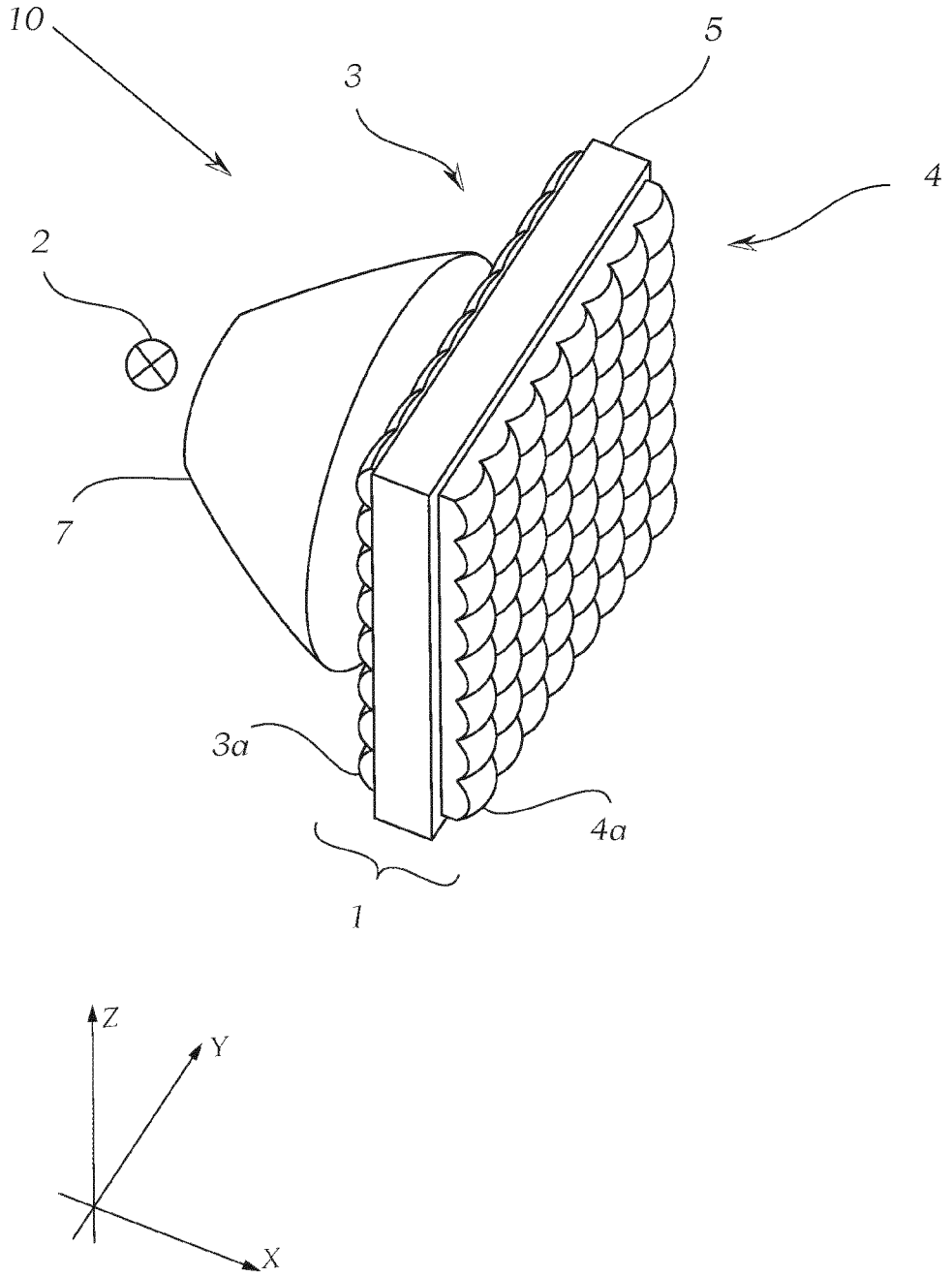

(51) Int. Cl.

| | |
|---|---|
| ***F21S 41/143*** | (2018.01) |
| ***F21S 41/32*** | (2018.01) |
| ***F21W 102/13*** | (2018.01) |

(56) References Cited

U.S. PATENT DOCUMENTS

| | | | | |
|---|---|---|---|---|
| 10,591,126 | B2 | 3/2020 | Mandl | |
| 10,612,741 | B2 | 4/2020 | Moser et al. | |
| 10,746,370 | B2 * | 8/2020 | Han | F21S 41/143 |

* cited by examiner

PROJECTION DEVICE FOR A MOTOR VEHICLE HEADLIGHT AND METHOD FOR PRODUCING A PROJECTION DEVICE

The invention pertains to a projection device for a motor vehicle headlight, wherein the projection device is configured for projecting light of at least one light source associated with the projection device in a region in front of a motor vehicle in the form of at least one light distribution, wherein the projection device comprises an input lens system that preferably is arranged in an array and an output lens system that preferably is arranged in an array, wherein exactly one microscopic output lens system is associated with each microscopic input lens system, wherein the microscopic input lens systems are configured in such a way and/or the microscopic input lens systems and the microscopic output lens systems are arranged relative to one another in such a way that essentially the entire light exiting a microscopic input lens system only enters the associated microscopic output lens system, wherein the light preformed by the microscopic input lens systems is projected in a region in front of the motor vehicle in the form of at least one light distribution by the microscopic output lens systems, wherein at least one transparent carrier is arranged between the input lens system and the output lens system, wherein the at least one carrier comprises at least one first screen device, wherein the first screen device is arranged in such a way that essentially the entire light entering the input lens system is directed at the first screen device, wherein the first screen device has an optically effective surface, and wherein transparent windows, which are bounded by an essentially opaque coating, are formed in the optically effective surface in order to produce a predefinable light distribution.

The invention also pertains to a microprojection light module for a motor vehicle headlight comprising at least one inventive projection device, to a vehicle headlight, particularly a motor vehicle headlight, comprising at least one inventive microprojection light module, as well as to a vehicle, particularly a motor vehicle, with at least one inventive vehicle headlight.

The invention furthermore pertains to a method for producing an inventive projection device for a motor vehicle headlight.

The invention furthermore pertains to a method for producing an inventive projection device for a motor vehicle headlight.

With respect to the prior art, we refer, e.g., to document AT 514967 B1 that describes a projection device. The lens systems become more and more sensitive to tolerances due to the increasing miniaturization of the input and output lens systems. Until now, it was attempted to reduce dimensional inaccuracies with the aid of improved production methods.

It was now surprisingly determined that the heat input into the projection device significantly influences its optical behavior. The heat input of a light source and the light absorption within the respective lens system or screen device can heat these elements to such a degree that the projection device causes projection errors. For example, lens systems and optionally provided screen devices may have different coefficients of thermal expansion due to material differences and therefore expand differently. This problem becomes even more severe if transparent elements such as the input lens system and the output lens system, as well as absorbing elements such as optionally provided screen devices, reach different temperature levels under the input of heat.

The invention is therefore based on the objective of developing a projection device, in which projection errors can be largely prevented despite increasing miniaturization. This objective is attained with a projection device of the initially described type, in which it is proposed that the opaque coating consists of partial layers that are arranged on top of one another in an at least planar manner, namely a reflective, metallic first partial layer and a second partial layer that essentially consists of black, light-absorbing paint, wherein the first partial layer is arranged between the input lens system and the second partial layer.

The inventive arrangement of an opaque coating, which comprises a metallic first partial layer and is covered by a black, light-absorbing second partial layer, makes it possible to significantly reduce the heat input into the screen device in that light directed at the screen device via the input lens system is not absorbed to a great extent in the screen device as it has been common practice so far, but rather reflected back again by the metallic first partial layer. Since the first partial layer is the first layer exposed to the full light flux supplied by the inlet lens system, the reflective properties of the first partial layer are particularly advantageous and therefore reduce the heat input into the at least one carrier, as well as any lens systems (e.g. the input and/or output lens system) arranged thereon, such that projection errors caused by thermal expansion are prevented.

In practical applications, the actual heat input into the screen device depends on the light flux, as well as the light distribution to be produced. In a low-beam light distribution, for example, approximately 40% of the light supplied by the input lens system is shaded by means of the screen device. The heat input into the screen device therefore is significantly reduced due to the reflection on the first partial layer. This retroreflected light also causes no interfering scattered light.

An additional effect that leads to a reduction of projection errors is also achieved due to the downstream arrangement of a black second partial layer. The arrangement of a metallic first partial layer without a follow-up layer would result in scattered light, which is returned into the screen device, to be once again reflected forward by the reflective layer. This would lead to undesirable crosstalk in a downstream lens system. This scattered light being returned into the screen device can be absorbed by means of the light-absorbing second partial layer in order to thereby prevent crosstalk. Since the scattered light only represents a small portion of the overall light flux, the thusly caused heat input into the screen device is negligible. The metallized layer also increases the opacity of the screen device.

At this point, it should be noted that additional screen devices may by all means be provided and arranged downstream of the at least one aforementioned screen device. For example, a second radiation screen configured for eliminating optical errors may be provided. The phrase "that essentially the entire light entering the input lens system is directed at the first screen device" refers to an arrangement, in which it is attempted to prevent scattered light and, if possible, to direct the entire light flux supplied into the input lens system at the first screen device. The phrase "an essentially opaque coating" refers to a coating that reduces light incident on this coating at least to such an extent that no transmission of light can be detected by the human eye.

In this context, the formulation "essentially the entire exiting light" means that it is attempted to actually irradiate the entire light flux exiting a microscopic input lens system into the associated microscopic output lens system only. If this is not possible due to the respective circumstances, it should be attempted to at least irradiate such a small light flux into the adjacent microscopic output lens systems that it does not cause any disadvantageous optical effects such as scattered light, which can lead to glare, etc.

In addition, the formulation "wherein the microscopic input lens systems are configured in such a way and/or the microscopic input lens systems and the microscopic output lens systems are arranged relative to one another in such a way" should also be interpreted such that additional measures such as screens (see further below) may be provided, wherein said additional measures either exclusively or preferably in addition to their actual function also have the function of directing the entire light flux exactly at the associated microscopic output lens system.

Due to the utilization of a number or plurality of microscopic lens systems instead of a single lens system of the type used in conventional projection systems, the focal lengths and the dimensions of the microscopic lens systems generally are significantly smaller than in a "conventional" lens system. The center thickness can likewise be reduced in comparison with a conventional lens system. In this way, the structural depth of the projection device can be significantly reduced in comparison with a conventional lens system.

The light flux can on the one hand be increased or scaled by increasing the number of microscopic lens systems, wherein the number of microscopic lens systems is primarily limited by the respectively available production methods. For example, 200 to 400 microscopic lens systems may respectively suffice or be advantageous for realizing a low-beam function, wherein this number is merely cited as an example and does not represent an upper or lower limiting value. It is therefore advantageous to increase the number of identical microscopic lens systems in order to increase the light flux. Vice versa, the plurality of microscopic lens systems can be used for incorporating microscopic lens systems with different optical behavior into a projection system in order to thereby produce or superimpose different light distributions. The plurality of microscopic lens systems therefore also allows design options that cannot be realized in a conventional lens system. Individual microscopic lens systems can have different focal lengths such that additional variances in the design of the light distribution are achieved. Some microscopic lens systems may be realized in the form of astigmatic lenses such that the incident light flux is affected differently, for example, in the horizontal and the vertical direction. Consequently, individual microscopic lens system can contribute, e.g., to changing the maximum value of the irradiance in a light distribution while other microscopic lens systems can be used for controlling the horizontal extent of the light distribution.

Such a projection device or light module is furthermore scalable, i.e. multiple light modules of identical or similar design can be combined so as to form a larger overall system, e.g. a vehicle headlight.

In a conventional projection system with one projection lens, the lens typically has a diameter between 60 mm and 90 mm. In an inventive module, the individual microscopic lens systems typically have dimensions of approximately 2 mm×2 mm (in V and H) and a depth of approximately 6 mm-10 mm (in Z; see, e.g., FIG. 1) such that an inventive module has a significantly smaller depth than conventional modules.

The inventive projection device has a smaller structural depth and basically can be formed freely, i.e. it is possible, e.g., to configure a first light module for producing a first partial light distribution separately of a second light module for a second partial light distribution and to freely arrange these light modules relative to one another in an offset manner, i.e. vertically and/or horizontally and/or depthwise, such that the realization of design specifications can also be simplified.

Another advantage of an inventive projection module can be seen in that the exact positioning of the light source(s) relative to the projection device is eliminated. Exact positioning is only circumstantial insofar as the at least one light source can potentially illuminate an entire array of microscopic input lens systems, all of which essentially produce the same light pattern. In other words, this simply means that the "actual" light source is formed by the real light source(s) and the array of microscopic input lens systems. This "actual" light source then illuminates the microscopic output lens systems and optionally the associated screens. However, inexact positioning of the real light source(s) is less important due to the fact that the microscopic input and microscopic output lens systems already are optimally adapted to one another because they effectively form one system. For example, the real light sources are approximately punctiform light sources such as light-emitting diodes, the light of which is collimated by collimators such as Compound Parabolic Concentrators (CPC) or TIR (Total Internal Reflection) lenses. The relative position between light source and projection device can be chosen freely due to the collimation of the light emitted by the light source.

The inventive projection device may be configured for producing various light distributions. Examples of such light distributions are cited below:

turning light distribution;
city light distribution;
country road light distribution;
expressway light distribution;
light distribution for additional light for expressway light;
cornering light distribution;
low-beam forefield light distribution;
light distribution for asymmetric low-beam light in the far field;
light distribution for asymmetric low-beam light in the far field in the cornering light mode;
high-beam light distribution;
non-glare high-beam light distribution.

Examples of the appearance of such light distributions are described, among other things, in document AT 514967 B1.

The second partial layer particularly may consist of black photoresist. In this way, the transparent regions can be uncovered in a dimensionally accurate and efficient manner. The term photoresist refers to a resist for photolithographic structuring, i.e. the solubility of the photographic layer is locally changed under an exposure mask or photographic template during the exposure, e.g., to ultraviolet light. A resist of this type is also referred to as photosensitive resist and commercially available, e.g., in the form of the product "Daxin ABK408X."

The metallic layer may advantageously consist of aluminum, chromium and/or black chromium, but alternatively also of magnesium, titanium, tantalum, molybdenum, iron, copper, nickel, palladium, silver, zinc, antimony, tin, arsenic or bismuth. The metallic layer could also be formed by semimetals/semiconductors such as silicon, gallium or indium.

A material with the lowest coefficient of thermal expansion possible may be used in order to reduce the thermal expansion effect on the carrier. To this end, the at least one carrier may at least partially or completely consist of glass.

Classic anti-reflection coatings (AR coatings), which positively affect the reflection behavior of the layer structure, particularly may be applied on the glass boundary layers. A refractive index adaptation between the glass carrier and the metallic partial layer particularly makes it possible to additionally reduce the heat input in that the reflectivity is increased.

The input lens system and the output lens system may also be rigidly connected to the at least one carrier. Relative positioning errors between the input lens system and the output lens system can thereby be prevented.

Two or more carriers may alternatively be arranged between the input lens system and the output lens system, wherein the input lens system and the output lens system respectively are rigidly connected to a carrier. The carriers may also be rigidly connected to one another.

The opaque coating may furthermore have a transmittance T of less than 0.001, preferably T less than 0.0002.

In addition, the reflective, metallic first partial layer may have a reflection coefficient of at least 0.55, preferably >0.85, for light in a wavelength range between 400 nm and 700 nm (i.e. for visible light).

The invention also pertains to a microprojection light module for a motor vehicle headlight, which comprises at least one inventive projection device, as well as at least one light source for supplying light into the projection device.

The light source may advantageously comprise at least one LED, preferably a number of LEDs, wherein each light source has a lens system that collimates the light and is configured and arranged for supplying the light into the input lens system in a collimated manner.

The invention also pertains to a vehicle headlight, particularly a motor vehicle headlight, which comprises at least one microprojection light module.

The invention furthermore pertains to a method for producing an inventive projection device, which comprises the steps of:

I) using and processing a transparent carrier for forming at least one first screen device with an optically effective surface in accordance with the following partial steps:

a) coating one side of the transparent carrier with a reflective, metallic first partial layer,
b) completely covering the first partial layer with a second partial layer consisting of black, light-absorbing photoresist,
c) exposing and developing the second partial layer in order to form transparent windows within the second partial layer, by means of which corresponding regions of the first partial layer are uncovered,
d) forming congruent transparent windows corresponding to step c) in the first partial layer by removing the corresponding regions of the reflective, metallic first partial layer by means of an etching or dissolving process, II) positioning the carrier obtained in accordance with step I) between an input lens system and an output lens system, wherein the input lens system comprises a plurality of microscopic input lens systems that preferably are arranged in an array, wherein the output lens system comprises a plurality of microscopic output lens systems that preferably are arranged in an array, wherein the first screen device is arranged in such a way that essentially the entire light entering the input lens system is directed at the first screen device, wherein transparent windows according to partial step I-d), which are bounded by an essentially opaque coating obtained by superimposing the first and second partial layers, are formed in the optically effective surface in order to produce a predefinable light distribution, and wherein the first partial layer is arranged between the input lens system and the second partial layer.

It is furthermore possible—as already mentioned in connection with the inventive projection device—that exactly one microscopic output lens system is associated with each microscopic input lens system, wherein the microscopic input lens systems are configured in such a way and/or the microscopic input lens systems and the microscopic output lens systems are arranged relative to one another in such a way that essentially the entire light exiting a microscopic input lens system only enters the associated microscopic output lens system, and wherein the light preformed by the microscopic input lens systems is projected in a region in front of the motor vehicle in the form of at least one light distribution by the microscopic output lens systems.

The full surface of the first partial layer may be advantageously covered with a second partial layer according to partial step I-b), which consists of black, light-absorbing photoresist, by means of spin coating or spray coating.

The layer thickness of the second partial layer particularly may lie between 0.5 and 4 micrometer and preferably amount to 1.5 micrometer. The layer thickness of the first partial layer lies between 100 and 400 nanometer and preferably amounts to 200 nm.

In other words, the invention makes it possible to use a light source in the form of LEDs, wherein the emitted light cone of the LED essentially can be collimated by means of collimator lens systems. This parallel light can be used as lighting for the microscopic lens array. In a microscopic lens stack, the parallel light initially may be respectively focused on a primary radiation screen (namely the first screen device) by means of a primary lens array, wherein the focused light is trimmed to the desired distribution (e.g. low-beam light) in this screen. The primary radiation screen may be followed by a secondary radiation screen that can correct optical errors in the system (undesirable crosstalk of light in downstream microprojection systems). The secondary lens array (the output lens system), which projects the desired light distribution on the road, is located on the end.

The first screen device makes it possible to fulfill the following requirements:

resolution accuracy <4 μm
temperature resistance between −40° C. and 180° C. over the service life of the vehicle
transmittance of preferably less than 0.0002
as light-absorbing as possible toward the front (in the driving direction).

Such a screen device can be obtained with the following steps:

Step 1: a glass substrate is completely metallized on one side. This may be realized, for example, by sputtering aluminum on the glass substrate (layer thickness in the range of 200 nm). It would alternatively also be possible, for example, to use chromium, black chromium, etc.

Step 2: a black negative photoresist can be applied over the full surface of the metallized layer by means of spin coating or spray coating (layer thickness between 1.5 and 2 μm). The photoresist can subsequently be exposed through a mask. The structured screen geometry can then be developed in the desired resolution accuracy (<4 μm) by means of developer fluid. However, it is also possible to use positive photoresist.

Step 3: the metallization can be uncovered by means of etching in a wet-chemical process. The structured black photoresist serves as etching mask in this step. The result is a structured radiation screen that comprises a reflective and a black layer on one side.

Figure 2:
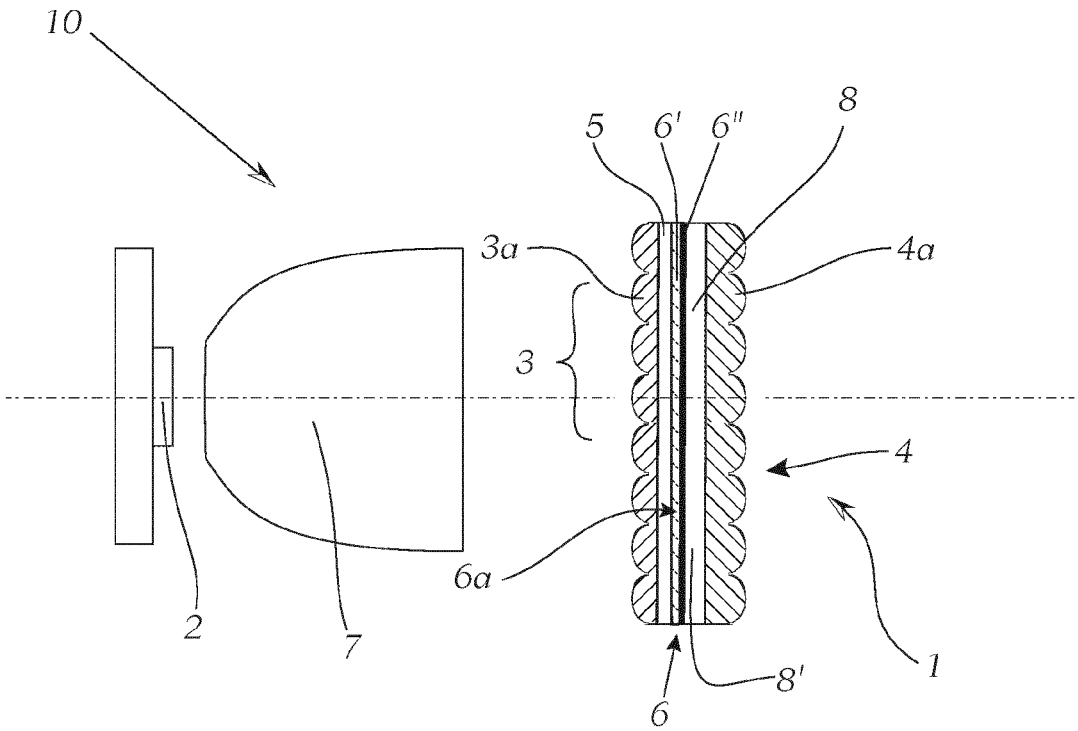
Figure 3:
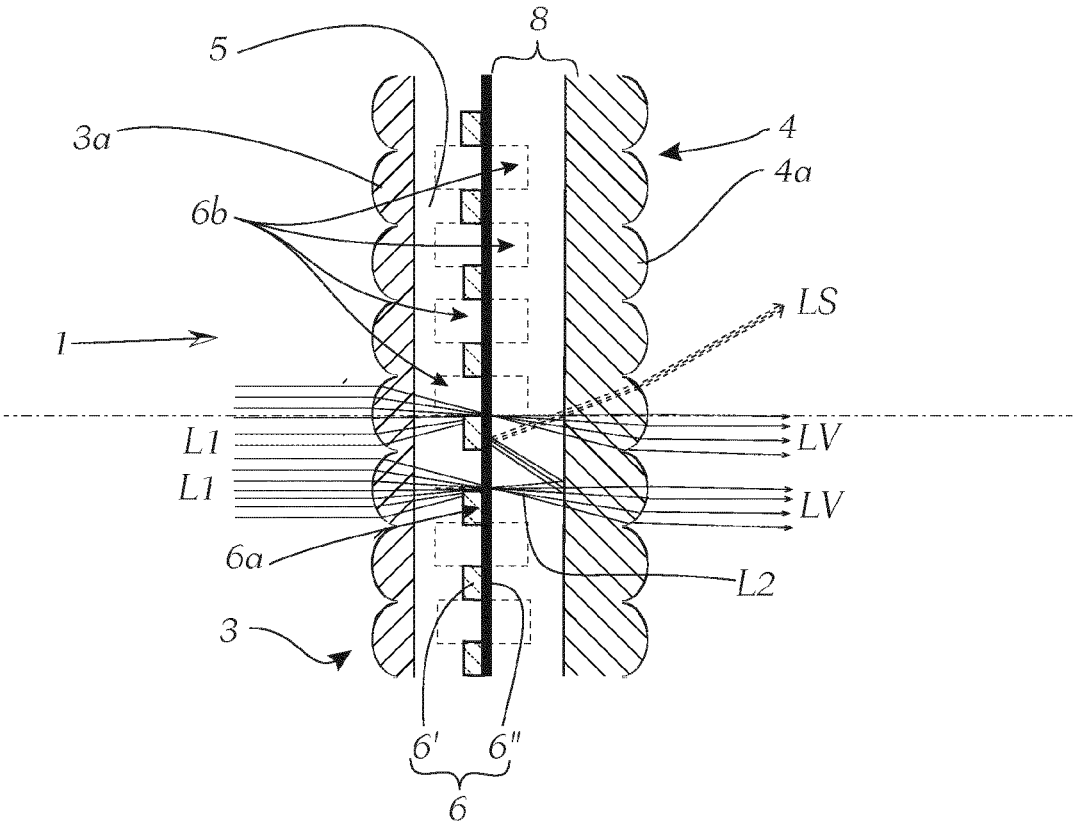

The invention is described in greater detail below with reference to an exemplary and non-restrictive embodiment that is illustrated in the figures. In these figures, FIG. 1 shows a perspective view of a microprojection light module containing a projection device prepared for the inventive use, FIG. 2 shows a schematic section through an inventive projection device, FIG. 3 shows a detail of a carrier illustrated in FIG. 2, and FIGS. 4*a* to 4*m* show exemplary steps for the production of an inventive projection device.

In the following figures, identical characteristics are—if not indicated otherwise—identified by the same reference symbols.

FIG. 1 shows a perspective view of a microprojection light module 10 containing a projection device that can also be used for the invention, wherein the light module 10 comprises a light source 2, a light-collimating lens system 7, an input lens system 3 comprising a number of microscopic input lens systems 3*a* that preferably are arranged in an array, a carrier and an output lens system 4. The output lens system 4 comprises a number of microscopic output lens systems 4*a* that preferably are arranged in an array.

The projection device 1 is suitable for installation in a motor vehicle headlight, wherein the axis x identifies in the installed state the longitudinal vehicle axis or the driving direction, the axis y identifies the horizontal axis that is oriented normal to the axis x and the axis z identifies a vertical axis that is oriented normal to the horizontal plane defined by the axes x and y.

FIG. 2 shows a schematic section through an inventive projection device 1 and a microprojection light module 10 for a motor vehicle headlight, which comprises at least one projection device 1 and at least one light source 2 for supplying light into the projection device 1. According to this figure, exactly one microscopic outlet lens system 4*a* is associated with each microscopic input lens system 3*a*. The microscopic input lens systems 3*a* are configured in such a way and/or the microscopic input lens systems 3*a* and the microscopic output lens systems 4*a* are arranged relative to one another in such a way that essentially the entire light exiting a microscopic input lens system 3*a* only enters the associated microscopic output lens system 4*a*. The light preformed by the microscopic input lens systems 3*a* is projected in a region in front of the motor vehicle in the form of at least one light distribution by the microscopic output lens systems 4*a*.

At least one transparent carrier 5 is arranged between the input lens system 3 and the output lens system 4, wherein the at least one carrier 5 comprises at least one first screen device 6, wherein the first screen device 6 is arranged in such a way that essentially the entire light entering the input lens system 3 is directed at the first screen device 6, wherein the first screen device 6 has an optically effective surface 6*a*, and wherein transparent windows 6*b* (see, e.g., FIGS. 3, 4*b* and 4*c*), which are bounded by an essentially opaque coating, are formed in the optically effective surface 6*a* in order to produce a predefinable light distribution.

FIGS. 2 and 3 show that the opaque coating consists of partial layers 6', 6" that are arranged on top of one another in an at least planar manner, namely a reflective, metallic first partial layer 6' and a second partial layer 6" that essentially consists of black, light-absorbing paint, wherein the first partial layer 6' is arranged between the input lens system 3 and the second partial layer 6". In the present case, this arrangement is produced in that both layers are arranged on the light output side of the first carrier 5 by initially applying the first partial layer 6' and subsequently applying the second partial layer 6". The exemplary light beams L1 show that light is directed at the optically effective surface 6*a* via the input lens system 3 and can pass through the transparent windows 6*b*. The light beams L2 passing through the windows 6*b* are incident on corresponding microscopic output lens systems 4*a* of the output lens system 4, wherein the majority of these light beams LV exit the microscopic output lens systems 4*a* outward. However, the output lens system 4 reflects a small (undesirable) portion back in the direction of the second partial layer 6", which is configured for absorbing these light beams and thereby preventing an uncontrolled reflection thereof in the direction of the output lens system 4. This makes it possible to effectively counteract crosstalk of light beams LS caused by reflection on the output lens system 4.

Figure 4:
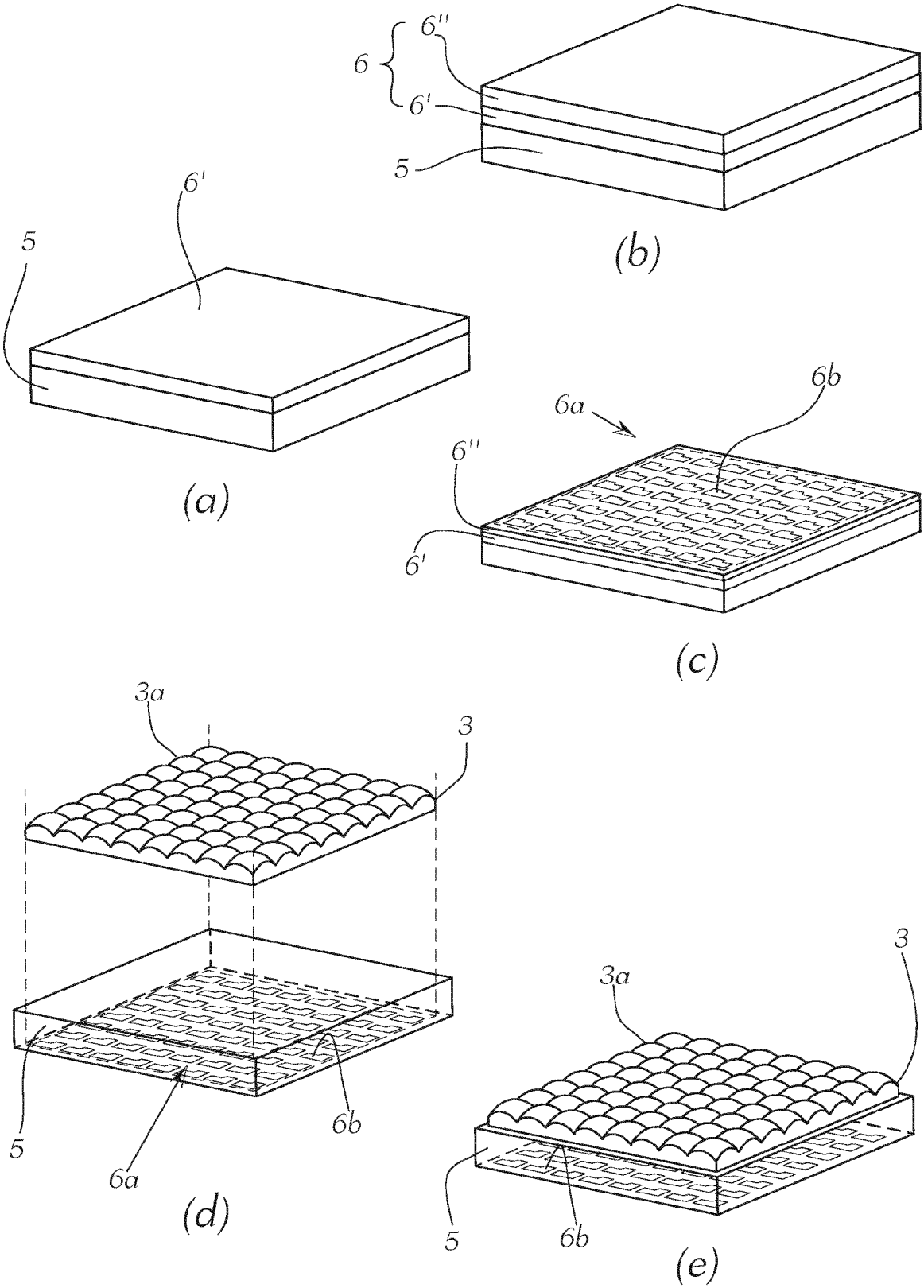
Figure 4:
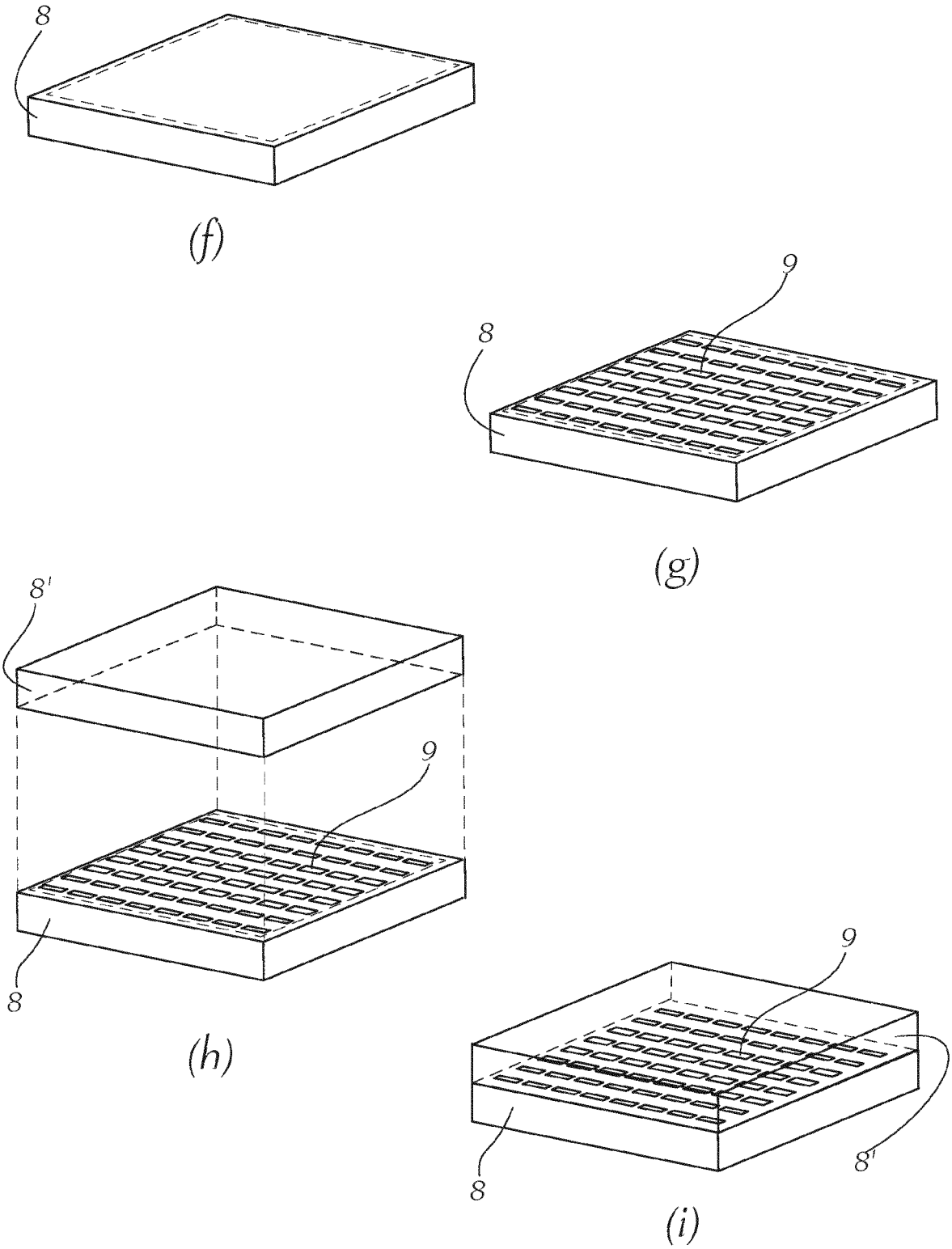
Figure 4:
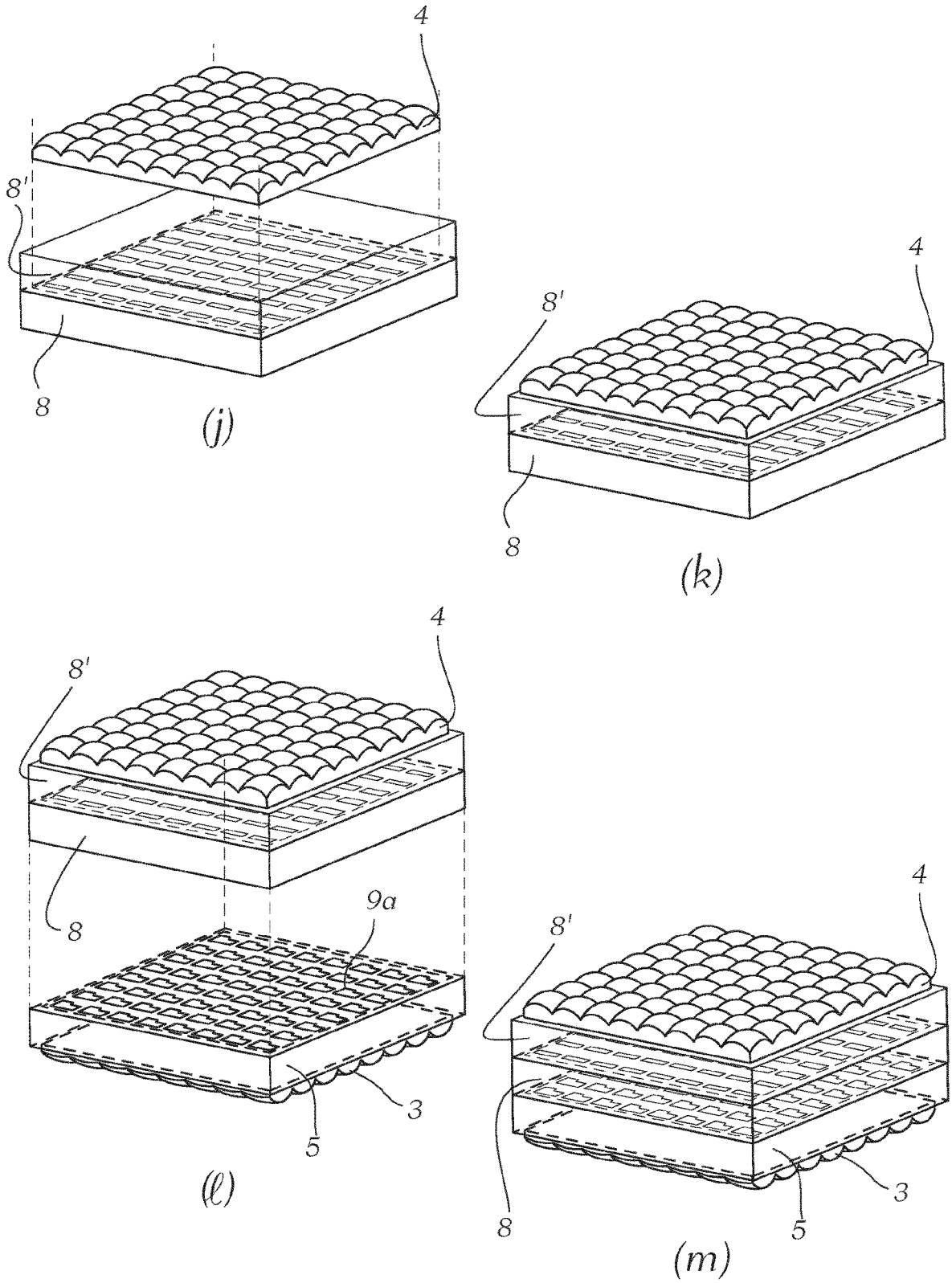

FIGS. 4*a* to 4*m* show exemplary steps for producing an inventive projection device 1. FIG. 4*a*) shows a transparent carrier 5 that is used for forming a first screen device 6 and processed as follows: according to FIG. 4*a*, one side of the carrier 5 is coated with a reflective, metallic first partial layer 6'. The full surface of the first partial layer 6' is subsequently covered with a second partial layer 6" (FIG. 4*b*) that consists of black, light-absorbing photoresist. In the next step, the second partial layer 6" is exposed and developed in order to form transparent windows within the second partial layer (FIG. 4*c*), by means of which corresponding regions of the first partial layer 6" are uncovered. Transparent windows 6*b* are subsequently formed in the first partial layer by removing the corresponding regions of the reflective, metallic first partial layer 6' with an etching process (see FIG. 4*d*). The contours of the transparent windows 6*b* may be configured arbitrarily; the exemplary design shown corresponds to a low-beam light distribution with an asymmetric rise. The input lens system 3 can subsequently be attached to the carrier 5 (FIG. 4*e*), wherein the first partial layer 6' is arranged between the input lens system 3 and the second partial layer 6". A second carrier 8 with another screen 9 for reducing optical projection errors arranged thereon is provided in the present exemplary embodiment. This carrier is composed of two elements, namely the screen carrier 8 and a cover element 8'. The output lens system 4 can be arranged on the cover element 8' (see FIGS. 4*f* to 4*k*). Lastly, the carriers 5 and 8 are connected to one another such that the input and output lens systems 3 and 4 lie opposite of one another and the screens 6 and 9 are arranged in between.

In light of this disclosure, a person skilled in the art is able to arrive at not-shown embodiments of the invention without additional inventive activity. The invention is therefore not limited to the embodiment shown. Individual aspects of the invention or the embodiment can also be selected and combined with one another. The underlying concepts are essential to the invention and can be realized in many different ways by a person skilled in the art familiar with this description, but nevertheless are preserved as such. Any reference symbols in the claims are exemplary and merely serve for the easier readability of the claims without restriction thereof.

The invention claimed is:

1. A projection device (1) for a motor vehicle headlight, wherein the projection device (1) is configured for projecting light of at least one light source (2) associated with the projection device (1) in a region in front of a motor vehicle in the form of at least one light distribution, the projection device (1) comprising:

an input lens system (3) having a plurality of microscopic input lens systems (3*a*) that are arranged in an array and an output lens system (4) having a plurality of microscopic output lens systems (4*a*) that are arranged in an array, wherein:

exactly one microscopic output lens system (4*a*) of the plurality of microscopic output lens systems is associated with each microscopic input lens system (3*a*) of the plurality of microscopic input lens systems, the microscopic input lens systems (3*a*) are configured in such a way and/or the microscopic input lens systems (3*a*) and the microscopic output lens systems (4*a*) are arranged relative to one another in such a way that essentially the entire light exiting a microscopic input lens system (3*a*) only enters the associated microscopic output lens system (4*a*), light preformed by the microscopic input lens systems (3*a*) is projected in a region in front of the motor vehicle in the form of at least one light distribution by the microscopic output lens systems (4*a*), at least one transparent carrier (5) is arranged between the input lens system (3) and the output lens system (4), wherein the at least one carrier (5) comprises at least one first screen device (6), wherein the first screen device (6) is arranged in such a way that essentially the entire light entering the input lens system (3) is directed at the first screen device (6), wherein the first screen device (6) has an optically effective surface (6*a*), and wherein transparent windows (6*b*), which are bounded by an essentially opaque coating, are formed in the optically effective surface (6*a*) in order to produce a predefinable light distribution, and the opaque coating consists of partial layers that are arranged on top of one another in an at least planar manner, namely a reflective, metallic first partial layer (6') and a second partial layer (6") that essentially consists of black, light-absorbing paint, wherein the first partial layer (6') is arranged between the input lens system (3) and the second partial layer (6").

2. The projection device (1) according to claim 1, wherein the second partial layer (6") consists of black photoresist.

3. The projection device (1) according to claim 1, wherein the reflective, metallic first partial layer consists of aluminum, chromium and/or black chromium or alternatively also of magnesium, titanium, tantalum, molybdenum, iron, copper, nickel, palladium, silver, zinc, antimony, tin, arsenic or bismuth.

4. The projection device (1) according to claim 1, wherein the at least one carrier (5) consists at least partially of glass.

5. The projection device (1) according to claim 1, wherein the input and output lens systems (3, 4) are rigidly connected to the at least one carrier (5).

6. The projection device (1) according to claim 1, wherein the at least one transparent carrier comprises two or more carriers (5, 8, 8') which are arranged between the input lens system and the output lens system (4), and wherein the input lens system (3) and the output lens system (4) respectively are rigidly connected to one of the two or more carriers (5, 8, 8').

7. The projection device (1) according to claim 1, wherein the opaque coating has a transmittance T of less than 0.001, preferably less than 0.0002.

8. The projection device (1) according to claim 1, wherein the reflective, metallic first partial layer (6') has a reflection coefficient of at least 0.55, preferably 0.85, for light in a wavelength range between 400 nm and 700 nm.

9. A microprojection light module (10) for a motor vehicle headlight, comprising:

at least one projection device (1) according to claim 1, and at least one light source configured to supply light into the at least one projection device.

10. The microprojection light module (10) according to claim 9, wherein the light source comprises at least one LED, preferably a number of LEDs, and wherein each light source has a lens system (7) that collimates the light of the at least one LED and is configured and arranged for irradiating the light into the input lens system (3) in a collimated manner.

11. A a motor vehicle headlight, comprising at least one microprojection light module (10) according to claim 9.

12. A method for producing a projection device (1) according to claim 1, comprising the following steps:

I) using and processing a transparent carrier for forming at least one first screen device (9) with an optically effective surface in accordance with the following partial steps:

a) coating one side of the transparent carrier with a reflective, metallic first partial layer (6'), b) completely covering the first partial layer (6') with a second partial layer (6") consisting of black, light-absorbing photoresist, c) exposing and developing the second partial layer (6") in order to form transparent windows within the second partial layer (6"), by means of which corresponding regions of the first partial layer (6') are uncovered, d) forming congruent transparent windows (6*b*) corresponding to step c) in the first partial layer (6') by removing the corresponding regions of the reflective, metallic first partial layer (6') by means of an etching or dissolving process, and II) positioning the carrier (5) obtained in accordance with step I) between an input lens system (3) and an output lens system (4), wherein the input lens system (3) comprises a plurality of microscopic input lens systems (3*a*) that preferably are arranged in an array, wherein the output lens system (4) comprises a plurality of microscopic output lens systems (4*a*) that preferably are arranged in an array, wherein the first screen device (6) is arranged in such a way that essentially the entire light entering the input lens system (3) is directed at the first screen device (6), wherein transparent windows (6*b*) according to partial step I-d), which are bounded by an essentially opaque coating obtained by superimposing the first and second partial layers (6', 6"), are formed in the optically effective surface (6*a*) in order to produce a predefinable light distribution, and wherein the first partial layer (6') is arranged between the input lens system (3) and the second partial layer (6").

13. The method according to claim 12, wherein the full surface of the first partial layer (6') is covered with a second partial layer (6") according to partial step I-b), which consists of black, light-absorbing photoresist, by means of spin coating or spray coating.

14. The method according to claim 12 or 13, wherein the layer thickness of the second partial layer (6") lies between 0.5 and 4 micrometer and preferably amounts to 1.5 micrometer.

15. The method according to claim 12, wherein the layer thickness of the first partial layer (6') lies between 100 and 400 nanometer and preferably amounts to 200 nanometer.

* * * * *